United States Patent [19]

Eggers et al.

[11] 4,354,949

[45] Oct. 19, 1982

[54] HYDRAULIC FLUID, HYDRAULIC EQUIPMENT CONTAINING THIS FLUID AND A CONCENTRATE OF THIS FLUID

[75] Inventors: Carl A. Eggers, Tarvin-near Chester; Gerald D. Galvin, Upton-by-Chester, both of England

[73] Assignee: Shell Oil Company, Houston, Tex.

[21] Appl. No.: 226,675

[22] Filed: Jan. 21, 1981

[30] Foreign Application Priority Data

Jan. 24, 1980 [GB] United Kingdom ..... 8002478

[51] Int. Cl.[3] ..... C10M 3/04; C10M 3/10; C10M 3/16; C10M 3/22

[52] U.S. Cl. ..... 252/39; 252/49.5; 252/51.5 R; 252/52 A; 252/73; 252/76; 252/77; 252/79

[58] Field of Search ..... 252/39, 49.5, 52 A, 252/73, 74, 75, 76, 77, 312; 424/170

[56] References Cited

U.S. PATENT DOCUMENTS

| | | | |
|---|---|---|---|
| 2,841,554 | 7/1958 | Ambrose | 252/49.5 |
| 2,967,831 | 1/1961 | Hommer | 252/77 |
| 2,976,240 | 3/1961 | Gilbert | 252/49.5 |
| 3,089,854 | 5/1963 | Meyers | 252/49.5 |
| 3,419,494 | 12/1968 | Teeter | 252/49.5 |
| 3,761,404 | 9/1973 | Calow | 252/39 |
| 3,859,221 | 1/1975 | Polk | 252/51.5 A |
| 4,160,370 | 7/1979 | Hacias | 252/49.5 |

FOREIGN PATENT DOCUMENTS

| | | | |
|---|---|---|---|
| 424 | 1/1979 | European Pat. Off. | 252/49.5 |

*Primary Examiner*—Dennis L. Albrecht

*Attorney, Agent, or Firm*—John M. Duncan; Ronald R. Reper

[57] ABSTRACT

Hydraulic fluids consisting of oil in water emulsion comprising 90–99%w of water, non-ionic emulsifier and 0.5–5%w of a high viscosity lubricating oil having a kinematic viscosity of 40° C. of at least 160 cS.

21 Claims, No Drawings

HYDRAULIC FLUID, HYDRAULIC EQUIPMENT CONTAINING THIS FLUID AND A CONCENTRATE OF THIS FLUID

BACKGROUND OF THE INVENTION

The invention relates to a hydraulic fluid, to hydraulic equipment containing this fluid and to a concentrate of this fluid.

hydraulic power transmission serves a wide range of purposes where multiplication of force is required or where accurate and dependable control gear must be provided.

The prime requirements of a hydraulic medium are that it should be relatively incompressible and sufficiently fluid to permit efficient transmission of power.

Apart from this a hydraulic fluid must also possess good lubrication properties for the pumps, bearings, etc., in the system. It should moreover ensure a good seal between moving parts, and should provide good protection against corrosion and wear.

If the risk of fire is very great, as in aeroplanes, coal mines or many applications in the steel industry, fire-resistant hydraulic fluids are used. These fluids very suitably consist of oil-in-water emulsions which contain at least 80% w of water, the balance being a mixture of lubricating oil, emulsifier and additives, such as anti-wear and anti-rust additives.

Hydraulic fluids consisting of oil-in-water emulsions which contain at least 80% w of water known hitherto show a number of drawbacks, such as premature fatigue pitting of rolling element bearings, and high wear of moving parts, such as bearings and pistons.

It has now been found that these drawbacks can be overcome by using an emulsion which comprises a lubricating oil of high viscosity.

SUMMARY OF THE INVENTION

According to the invention there is provided a hydraulic fluid which is an oil-in-water emulsion and comprises from 90–99% w of water and from 0.5–5% w of a lubricating oil with a kinematic viscosity at 40° C. of at least 160 cS and 10–80% w of the oil of an emulsifier. Preferably, the amount of water is from 94–99% w and the amount of lubricating oil from 0.5–4% w. The invention further provides a concentrate of a hydraulic fluid comprising 0–90% w water, 91–9.0% w of a lubricating oil having a kinematic viscosity of 40° C. of at least 160 cS and 50–1.0% of the oil of a non ionic emulsifier.

DESCRIPTION OF PREFERRED EMBODIMENTS

Lubricating oils are in general obtained by vacuum distillation of naphthenic or paraffinic mineral oils from which the light components have been removed by atmospheric distillation. From the fractions obtained in the vacuum distillation lubricating oil fractions can be prepared by extraction of aromatic compounds with suitable solvents (e.g., phenol, sulfur dioxide, sulfolane, 2-methyl pyrrolidane) and/or dewaxing and/or a treatment with acid and/or clay. From the residue obtained after the vacuum distillation of a paraffinic mineral oil a lubricating oil fraction herein called bright stock is obtained by deasphalting, solvent extraction, dewaxing and acid or clay treatment as mentioned above. As is well known in the art one or more of the treatments mentioned for distillates or deasphalted vacuum residue (extraction, dewaxing, acid and/or clay treatment) may be replaced partly or totally by a catalytic treatment with hydrogen under appropriate conditions. The lubricating oil fractions obtained may be used as lubricating oils as such, or they may be blended to yield lubricating oils with desired viscosities.

The lubricating oil to be used in the hydraulic fluids according to the invention preferably contains residual components of a vacuum distillation of a mineral oil, and most preferably consists of bright stock. Preferably, the lubricating oil has a kinematic viscosity at 40° C. of at least 300 cS, and particularly of at least 400 cS.

In order to emulsify the lubricating oil-in-water an emulsifier must be present in the hydraulic fluids according to the invention. Cationic and anionic emulsifiers are suitable. Preference is given to non-ionic emulsifiers and in this class those consisting of a condensation product of one or more alkylene oxides with one or more compounds with a reactive hydrogen atom are very suitable.

This type of emulsifiers may be obtained by condensation of compunds with an active hydrogen atom (such as alkyl phenols, carboxylic acids and alcohols) with ethylene oxide and/or propylene oxide.

When a compound with an active hydrogen atom (e.g., a carboxylic acid) reacts with one alkylene oxide molecule, the compound formed again has an active hydrogen atom which can react with another molecule of alkylene oxide. In this way emulsifiers which contain polyoxyalkylene chains are obtained. It is also possible to prepare non-ionic emulsifiers by reacting a compound with an active hydrogen atom with a polymer of an alkylene oxide, which polymer contains a number of oxyalkylene units and at least one hydroxyl group.

In order to emulsify the lubricating oils with a kinematic viscosity at 40° C. of at least 160 cS according to the invention very suitable emulsifiers are those described in European Patent Application 424, which emulsifiers contain one type of polymeric component which is derived from an oil-soluble complex monocarboxylic acid (polymeric component A) and another type of polymeric component which is the residue of a water-soluble compound containing polyoxyalkylene chains (polymeric component B).

The polymeric component A can very suitably be prepared from a hydroxy alkanoic acid by intermolecular esterification in the presence of a carboxylic acid which does not contain a hydroxyl group, which acts as a chain stopper. Very suitable hydroxy alkanoic acids are those with 8–24 carbon atoms, in particular 12-hydroxy stearic acid. As chain stopper any monocarboxylic acid can be used; stearic acid is very suitable. Polymeric components A with a molecular weight of at least 500 are preferred.

Polymeric component B very suitably is polyethylene oxide with a molecular weight of at least 500.

Polymeric components B may contain one or more hydroxyl groups, dependent on its method of preparation. The ultimate number of hydroxyl groups in polymeric component B is equal to the number of active hydrogen atoms present in the initiating agent for the polymerization of the alkylene oxide. For example, polymeric components B with one hydroxyl group are obtained in case where the initiating agent is water or a monohydric alcohol. Components B with two hydroxyl groups are obtained in case a glycol is used as initiating agent for the polymerization of the alkylene oxide. It is preferred that the number of hydroxyl groups present in polymeric component B is at least two, and that in the emulsifier each of the hydroxyl groups present in polymeric compound B has been reacted with a molecule of polymeric component A.

In the emulsifier, the weight proportion of polymeric component B is very suitably from 20% to 80%, and particularly from 25%–40%.

Non-ionic emulsifiers which are also very suitable to be used in order to emulsify the lubricating oils with a kinematic viscosity at 40° C. of at least 160 cS according to the invention are alkyd resins which comprise a residue of a polyalkylene glycol, e.g., as described in British Patent Specification No. 1,459,104.

If desired, a combination of two or more emulsifiers which need not to be of the same type (e.g., combinations of a non-ionic emulsifier with either a cationic or an anionic emulsifier) can be used in order to enhance the emulsifying properties and accordingly facilitate emulsification of the lubricating oil. The presence of a non-ionic emulsifier with molecular weight of at least 1000 and a non-ionic emulsifier with molecular weight below 1000 is preferred.

Examples of non-ionic emulsifiers with a molecular weight below 1000 are condensation products of low molecular weight alk(en)yl succinic anhydride with polyethylene glycol, condensation products of polyalcohols with fatty acids in which not all of the hydroxyl groups of the polyalcohol have reacted with the fatty acid, e.g., propylene-glycol mono-stearate, sorbitan-tristearate, condensation products of alkyl phenols and ethylene oxide, e.g., octylphenoxy ethanol.

The amount of emulsifier used may vary between wide limits. Very suitably the amount of emulsifier is from 10–80% w of the amount of lubricating oil present; 15–25% w is preferred.

One of the problems which may arise when using water-containing hydraulic fluids is fatigue pitting of ball, roller or needle-roller bearings used in hydraulic pumps. In order to prevent failure of hydraulic equipment due to pitting it is of advantage that so-called anti-pitting additives are present in the hydraulic fluids according to the invention. Very suitable anti-pitting additives are, e.g., glycols, amines, such as piperazine, morpholine, 3-amine-1,2,4-triazole, and mono-alkyl or di-alkylaminoalkanols, and particularly N-isopropylethanolamine. The amount of anti-pitting additive may vary between wide limits, amounts from 0.1–30% w of the amount of lubricating oil present are preferred.

Another problem which may arise when using water-containing hydraulic fluids is rusting of iron- and steel parts.

For that reason the presence of anti-rust additives in hydraulic fluids is of advantage. Very suitable anti-rust additives are tri-ethanolamine and di-ethanol amine.

It has been found that the anti-rust activity of these compounds is enhanced when an overbased calcium salt of an alkylsalicylic acid is also present.

The amount of anti-rust additives is very suitably from 0.5–10% w of the amount of lubricating oil present, although lower or higher amounts may suitably be used.

If needed, other types of additives may also be present, for example, zinc deactivators (such as condensation products of fatty acids and alkanolamines, alkali salts of aromatic carboxylic acids (e.g., sodium benzoate)) and/or fungicides.

Since alkanolamines may be rather basic and may attack yellow metals often used in hydraulic systems, it may be desirable to add acids, preferably in stoichiometric quantities, to the alkanolamines, preferably with stirring.

Especially for weak acids moderate heating, e.g., to about 35°–40 C., may be necessary to complete the neutralization reaction. Alternatively, the reactants can be mixed in a closed reaction vessel rotating slowly for up to one hour in an oven maintained at the desired temperature. Depending on the reaction conditions salts or amides are formed.

The neutralization reaction can be carried out directly in the oil phase or the reactants can be first reacted and then added to the oil phase.

Suitable acids are acid phosphates and saturated or unsaturated mono- or di-carboxylic acids having, e.g., at least 2 carbon atoms, or their anhydrides or derivatives. Examples of such acids are acetic acid, octanoic acid, oleic acid, sulphurized oleic acid, alkenyl, e.g., dodecenyl, succinic acid or its anhydride or its monoester with, e.g., alkanols, mono- or polyglycols.

Owing to the high water content the present dilute emulsions have low viscosities. It may be desirable to thicken the water phase to prevent or decrease piston wear, pump bearing failure or valve erosion and to increase the volumetric efficiency of the pumps of the hydraulic system.

Preferred thickeners are water-soluble, preferably shear-stable polymers at concentrations of, e.g., 0.1–5, preferably 0.1–2% w of water phase. Suitable polymers are high-molecular weight polyoxyethylene compounds, and their derivatives, such as esters, e.g., oleyl esters thereof, polysaccharides, polyvinyl pyrrolidones, cellulosics, polyacryl amides, polyalkyl acrylates, polybutenes, including polyisobutenes and fumed silicas and aluminas of very small particle size, e.g., smaller than 1 micron.

Also, "in situ" thickening of dilute emulsions by micellization or forming of invert emulsions is suitable.

It is also possible to "thicken" the water film adjacent to the metal surfaces by the presence of certain metal ions, or to add to the water phase rheopectic materials, which thicken or semi-gel this phase on pressure release.

The above thickened dilute emulsions may even be suitable to lubricate, e.g., gear boxes, compressors or may be used as crankcase lubricating oils.

In general, the hydraulic fluids according to the invention will be prepared by emulsification of a mixture of the lubricating oil and the appropriate additives, into water. In order to secure a long-term stability of the hydraulic fluids according to the invention the emulsification is very suitably carried out with the aid of a high shear emulsification apparatus, such as a Silverson mixer. Emulsification may also be carried out in the equipment in which the hydraulic fluid is to be used, e.g., in a vane-, piston- or gear pump.

The use of concentrates of the hydraulic fluids according to the invention may be of advantage, e.g., for handling or shipping. For that reason the invention also relates to concentrates of hydraulic fluids which concentrates contain 0–90, preferably 0–50% w water, and comprise a lubricating oil with a kinematic viscosity at 40° C. of at least 160 cS, and, e.g., an emulsifier which contains one type of polymeric component which is derived from an oil-soluble complex monocarboxylic acid and another type of polymeric component which is the residue of a water-soluble compound containing polyoxyalkylene chains, as discussed above.

The hydraulic fluids according to the invention are very suitably incorporated in equipment to be used for hydraulic purposes where fire resistance is desirable, such as in aeroplanes, in coal mines, die-casting and in the steel industry.

The invention also relates to hydraulic equipment containing a hydraulic fluid which consists of an oil-in-water emulsion and comprises from 90–99% w of water, from 0.5–5% w of a lubricating oil with a kinematic viscosity at 40° C. of at least 160 cS, and an emulsifier, as described hereinbefore.

EXAMPLE 1

A mixture was prepared of:

- 20% w of an emulsifier consisting of a block copolymer $(A\text{-}COO)_2\text{-}B$ in which each A component is the residue of poly-(12-hydroxystearic acid) chain terminated with stearic acid and of molecular weight approximately 1750, and the B component is the residue of polyethylene glycol of molecular weight approximately 1500;
- 3% w of an emulsifier consisting of propylene glycol monostearate;
- 10% w of isopropylaminoethanol;
- 2.5% of triethanolamine;
- 1.25% of a condensation product of fatty acids and alkanolamines;
- 0.5% of sodium benzoate;
- 0.25% w of a fungicide;
- 62.5% of a lubricating oil with a viscosity of 560 cS at 40° C.

This mixture was emulsified at 5% concentration into distilled water with the aid of a Silverson mixer to yield a hydraulic fluid according to the invention (Fluid I).

EXAMPLE 2

A mixture was prepared of:

- 17% w of the block copolymer emulsifier, described in Example 1;
- 3% w of sorbitan tri-stearate;
- 10% w of isopropylaminoethanol;
- 1% w of triethanolamine;
- 0.75% w of a condensation product of fatty acids and alkanolamines;
- 0.5% w of alkyl-2,5-di-mercapto-1,3,4-thiadiazole;
- 0.25% w of fungicide;
- 67.5% w of a lubricating oil with a viscosity of 310 cS at 40° C.

This mixture was emulsified by the method described in Example 1 (Fluid II).

EXAMPLE 3

A mixture was prepared of:

- 17% w of the block copolymer emulsifier, described in Example 1;
- 3% w of propylene glycol monostearate;
- 10% w of isopropylaminoethanol;
- 1% w of triethanolamine;
- 0.75% w of a condensation product of fatty acids and ankanolamines;
- 0.5% w of alkyl-2,5-mercapto-1,3,4-thiadiazole;
- 0.25% w of fungicide;
- 67.5% w of a lubricating oil with a viscosity of 310 cS at 40° C.

This mixture was emulsified by the method described in Example 1 (Fluid III).

EXAMPLE 4

A mixture was prepared of:

- 20% w of the block copolymer emulsifier described in Example 1;
- 2.5% w of an emulsifier consisting of octylphenoxyethanol;
- 10% w of isopropylaminoethanol;
- 2% w of triethanolamine;
- 0.75% w of a condensation product of fatty acids and alkanolamines;
- 1% w of alkyl-2,5-di-mercapto-1,3,4-thiadiazole;
- 0.25% w of fungicide;
- 63.5% of the lubricating oil described in Example 1.

This mixture was emulsified by the method described in Example 1 (Fluid IV).

EXAMPLE 5

For comparison 5% w of a commercial oil composition which is sold as basis for a hydraulic fluid, and which contains a lubricating oil with a viscosity of about 40 cS at 40° C., was emulsified with 95% w water (Fluid V).

TESTING

Fluids I and V were tested for their anti-pitting properties in the Unisteel rig according to the IP 305/74 T method which specified that a 9-ball cage lubricated with the test fluid shall be rotated at 1500 rev./min. under a 3300 N bearing load against a plain bearing made up in the steel (En 31 in this case) that is usually used in the manufacture of the rolling bearings for hydraulic pumps. The test is terminated at the appearance of the first pit in the plain bearing.

Table 1 shows the results:

TABLE 1

| | $L_{10}$[(1)] life (hours) | $L_{50}$[(1)] life (hours) |
|---|---|---|
| Fluid I | 56 | 128 |
| Fluid V | 8 | 18 |

[(1)] $L_{10}$ and $L_{50}$ are the lives to 10% and 50% failure, respectively, of a (statistically significant) number of identical test pieces lubricated with a chosen fluid.

As can be seen Fluid I according to the invention gives much longer protection against pitting than comparative Fluid V.

Fluids I and V were also tested in a Sperry-Vickers PFB 5 axial piston pump, described in Section C5 of Sperry-Vickers American Catalogue, published in Troy (Mich.), Jan. 11, 1972. The conditions were duplicate 250 h runs, 210 bar pump outlet pressure, 1500 r.p.m. shaft rotation, 50° C. bulk fluid temperature, 0.5 m static inlet head.

Table 2 shows the results; the performance of Fluid I according to the invention is much superior to that of the comparative Fluid V.

TABLE 2

| Fluid | Piston wear (mg) | Piston slipper lift increase (micrometers) | Drop in volumetric efficiency of pump over test period, % |
|---|---|---|---|
| I | 202 | 127 | 1 |
| V | 924 | 1168 | 18 |

Fluids I, III, IV and V were tested in a Reyrolle A70 axial piston pump, described in pamphlet RH 105 of Reyrolle Hydraulic Catalogue, of April 1976. The conditions were 250 h runs (all in duplicate), 210 bar pump output pressure, 1500 r.p.m. shaft rotation, 40° C. bulk fluid temperature, 0.5 m static inlet head.

Table 3 agains shows that the fluids according to the invention show better results than the comparative Fluid V.

TABLE 3

| Fluid | Piston wear (mg) | Piston slipper lift increase (micrometers) | Drop in volumetric efficiency of pump over test period, % |
|---|---|---|---|
| I | 172 | 381 | 11 |
| III | 157 | 254 | 4 |
| IV | 162 | 229 | 12 |
| V | 669 | 889 | 13 |

Table 4 shows that in the Reyrolle A70 axial piston pump test the comparative Fluid V failed after about 400 hours, Fluid IV showing a good performance in a (single) 1500 h run.

TABLE 4

| Fluid | Piston wear (mg) | Piston slipper lift increase (micrometers) | Drop in volumetric efficiency of pump over test period, % |
|---|---|---|---|
| IV | 271 | 127 | 11 |

V - failed after 408 hours.

Fluids I and II were tested in a Sperry-Vickers V104C vane pump described in Drawing EN-I-138094 of Sperry-Vickers UK Catalogue (published Havant, 14th Feb., 1972). The conditions were 75 h runs at 35 bar pump output pressure, 1500 r.p.m. shaft rotation, 40° C. bulk fluid temperature, 0.5 m static inlet head. Table 5 shows that the fluids according to the invention show much superior results than the comparative Fluid V. Table 6 demonstrates the excellent performance of the Fluid II made according to the invention on this same pump under more severe conditions (49 bar, 50° C. bulk fluid temperature, for 500 h).

TABLE 5

| Fluid | Ring and vane wear (mg) |
|---|---|
| I | 92 |
| II | 256 |
| V | 1839 |

TABLE 6

| Fluid | Ring and vane wear (mg) |
|---|---|
| II | 215 |

What is claimed is:

1. A hydraulic fluid which is an oil-in-water emulsion and comprises from 90–99% w of water, from 0.5–5% w of a lubricating oil with a kinematic viscosity at 40° C. of at least 300 cS, and 10–80% w of the amount of oil of at least one non-ionic emulsifier.

2. A hydraulic fluid according to claim 1, in which the amount of water is from 94–99% w, and the amount of lubricating oil is from 0.5–4% w.

3. A hydraulic fluid according to claim 1 in which the lubricating oil comprises residual components of a vacuum distillation of a mineral oil.

4. A hydraulic fluid according to any one of the preceding claims in which the lubricating oil has a kinematic viscosity at 40° C. of at least 400 cS.

5. A hydraulic fluid according to claim 1, in which said non-ionic emulsifier consists of a condensation product of one or more alkylene oxides with one or more compounds with a reactive hydrogen atom.

6. A hydraulic fluid according to claim 5, in which the alkylene oxides are ethylene oxide and/or propylene oxide, and the compounds with a reactive hydrogen atom are carboxylic acids.

7. A hydraulic fluid according to claim 6, in which the emulsifier contains one type of polymeric component which is derived from an oil-soluble complex mono-carboxylic acid (polymeric component A) and another type of polymeric component which is the residue of a water-soluble compound containing polyoxyalkylene chains (polymeric component B).

8. A hydraulic fluid according to claim 7, in which the polymeric component A has a molecular weight of at least 500 and consists of a poly-(12-hydroxystearic acid) chain terminated with stearic acid, and the polymeric component B has a molecular weight of at least 500 and is derived from ethylene oxide.

9. A hydraulic fluid according to claim 7, in which in the emulsifier each of the hydroxyl groups present in polymeric component B has been esterified with a molecule of polymeric component A.

10. A hydraulic fluid according to claim 1 which contains a non-ionic emulsifier with molecular weight below 1000.

11. A hydraulic fluid according to claim 1 which comprises at least one anti-pitting additive.

12. A hydraulic fluid according to claim 11 in which the anti-pitting additive is N-isopropyl ethanolamine.

13. A hydraulic fluid according to claim 11 in which the amount of the anti-pitting additive is from 0.1–30% w of the amount of lubricating oil present.

14. A hydraulic fluid according to claim 1 which comprises at least one anti-rust additive.

15. A hydraulic fluid according to claim 14 which comprises di-ethanolamine and/or tri-ethanolamine as an anti-rust additive.

16. A hydraulic fluid according to claim 14 which comprises an overbased calcium salt of an alkyl salicylic acid.

17. A hydraulic fluid according to claim 14, in which the total amount of anti-rust additives is from 0.5–10% w of the amount of lubricating oil present.

18. A hydraulic fluid according to claims 12 or 15 comprising an acid in up to stoichiometric quantities of alkanol amine present.

19. A hydraulic fluid according to claim 18, wherein the acid is an alkenyl succinic anhydride.

20. A hydraulic fluid according to claim 1 comprising a thickened water phase.

21. A concentrate of a hydraulic fluid which contains 0–90% w water, 91–9.0% w of a lubricating oil having kinematic viscosity at 40° C. of at least 300 cS and 50–1.0% w of a non-ionic emulsifier.

* * * * *